United States Patent [19]

Nakajima

[11] Patent Number: 5,049,041

[45] Date of Patent: Sep. 17, 1991

[54] LUBRICATING OIL SUPPLY DEVICE FOR VAN COMPRESSORS

[75] Inventor: Nobuyuki Nakajima, Konan, Japan

[73] Assignee: Diesel Kiki Co., Ltd., Tokyo, Japan

[21] Appl. No.: 476,693

[22] Filed: Feb. 7, 1990

[30] Foreign Application Priority Data

Mar. 20, 1989 [JP] Japan ..... 1-68588

[51] Int. Cl.[5] ..... F04C 29/02; F04B 49/00

[52] U.S. Cl. ..... 417/295; 418/86; 418/100

[58] Field of Search ..... 417/295, 310; 418/86, 418/100

[56] References Cited

U.S. PATENT DOCUMENTS 4,834,634 5/1989 Ono ..... 418/100

FOREIGN PATENT DOCUMENTS 30767 11/1970 Japan .
70684 4/1987 Japan .
129593 6/1987 Japan .
25346 7/1988 Japan .
3295 1/1989 Japan .

*Primary Examiner*—Robert G. Nilson
*Attorney, Agent, or Firm*—Charles S. McGuire

[57] ABSTRACT

A vane compressor has at least one compression space defined between a rotor and a cylinder. A shaft seal and a bearing are fitted on a driving shaft and disposed adjacent to each other. A lubricating oil supply device supplies compression medium to the shaft seal and the bearing, through at least one passage extending between the at least one compression space and the shaft seal and the bearing. The at least one passage has an open end opening into the at least one compression space at a predetermined circumferential location at which pressure within the at least one compression space changes from a negative value into a positive value when each of the vanes passes the predetermined circumferential location, whereby lubrication and cooling of the shaft seal and the bearing is effected in an efficient manner.

8 Claims, 5 Drawing Sheets

LUBRICATING OIL SUPPLY DEVICE FOR VAN COMPRESSORS

BACKGROUND OF THE INVENTION

This invention relates to a lubricating oil supply device for vane compressors, and more particularly to a device of this kind which is adapted to lubricate a shaft seal and shaft bearings thereof while cooling them.

Lubricating oil supply devices for vane compressors are known e.g. from Japanese Utility Model Publication (Kokoku) No. 45-30767, Japanese Utility Model Publication (Kokoku) No. 63-25346, etc.

The known lubricating oil supply devices are each designed such that compression medium with lubricating oil mixed therein is supplied under low pressure from a suction side of the compressor to a shaft seal and shaft bearings, before being compressed, to simultaneously cooling and lubricate the shaft seal and the shaft bearings.

On the other hand, a variable capacity compressor has been proposed e.g. by Japanese Provisional Patent Publication (Kokai) No. 62-129593 by the assignee of the present application, which has a control plate for varying the opening degree of refrigerant inlet ports to thereby control the capacity. In the proposed compressor, the control plate and driving means therefor are arranged on the rear side of the compressor for facilitating the maintenance, and accordingly a discharge pressure chamber is arranged on the front side. Consequently, a shaft seal and a shaft bearing on the front side are apt to be heated by compressed compression medium within the discharge pressure chamber, which requires more effective cooling of the shaft seal to prevent the same from being hot and hence having a shortened life.

In order to supply compression medium under low pressure from the suction chamber to the shaft seal and the shaft bearing on the front side to effectively cool them, a lubricating oil supply device has been proposed by Japanese Provisional Patent Publication (kokai) No. 64-3295 by the assignee of the present application, which comprises a first lubricating oil passage extending in the driving shaft of the compressor along the axis thereof and communicating the suction chamber with a shaft seal chamber accommodating a shaft seal and a shaft bearing, and a second lubricating oil passage communicating the shaft seal chamber with a compression chamber on the suction stroke, whereby a cycle of compression medium is formed in which the medium flows from the suction chamber to the compression chamber on the suction stroke through the first lubricating oil passage, the shaft seal chamber, and the second lubricating oil passage, due to negative pressure created within the compression chamber on the suction stroke by the rotation of the vanes.

However, the proposed lubricating oil device thus ultilizing the negative pressure created within the compression chamber has the following disadvantages: When the vanes further rotate so that the compression chamber executes the compression stroke to create positive pressure therein, the above-mentioned cycle of compression medium is no longer formed. The rotational angle range of the vanes, over which the negative pressure is created, is too small to create negative pressure required to supply a sufficient amount of compression medium to the shaft seal chamber, resulting in poor cooling of the shaft seal chamber.

Further, the first lubricating oil passage is formed directly in the driving shaft so that the diameter of the former has to be so small as to assure required strength of the driving shaft, which makes it impossible to obtain satisfactory lubrication.

SUMMARY OF THE INVENTION

It is therefore the object of the invention to provide a lubricating oil supply device for vane compressors, which is simple in construction, but excellent in lubrication effect as well as in cooling effect with the use of compression medium containing lubricating oil.

To attain the object, according to a first aspect of the present invention, there is provided a vane compressor having a cylinder, a driving shaft having a portion thereof arranged within the cylinder, a rotor received within the cylinder and secured on the driving shaft, at least one compression space defined between the rotor and the cylinder, a plurality of vanes carried by the rotor, a shaft seal and a bearing fitted on the driving shaft and disposed adjacent to each other, and lubricating oil supply means for supplying compression medium to the shaft seal and the bearing.

The vane compressor according to the first aspect of the invention is characterised by the improvement wherein the lubricating oil supply means comprises at least one passage extending between the at least one compression space and the shaft seal and the bearing, the at least one passage having an open end opening into the at least one compression space at a predetermined circumferential location at which pressure within the at least one compression space changes from a negative value into a positive value when each of the vanes passes the predetermined circumferential location.

Preferably, the vane compressor includes a side block forming part of the cylinder, and wherein the at least one passage is formed in the side block.

More preferably, the predetermined circumfereintial location is a location which is slightly downstream of a rotational angle position of each of the vanes at which a compression stroke starts.

The vane compressor may include capacity control means for controlling the capacity of the compressor by varying a position of each of the vanes at which a compression stroke starts, and wherein the predetermined circumferential location is a location which is slightly downstream of a rotational angle position of each of the vanes at which the compression stroke starts while the capacity means is controlling the capacity of the compressor to a minimum value.

According to a second aspect of the present invention, there is also provided a vane compressor having a cylinder, a driving shaft having a portion thereof arranged within the cylinder, a rotor received within the cylinder and secured on the driving shaft, a pair of compression spaces defined between the rotor and the cylinder at circumferentially opposite locations, an odd number of vanes carried by the rotor and circumferentially arranged at equal intervals, a shaft seal and a bearing fitted on the driving shaft and disposed adjacent to each other, and lubricating oil supply means for supplying compression medium to the shaft seal and the bearing.

The vane compressor according to the second aspect of the present invention is characterised by the improvement wherein the lubricating oil supply means comprises first and second passages, the first passage extending between one of the compression spaces and the shaft seal and the bearing, the second passage extending between the other of the compression spaces and the shaft seal and the bearing, the first and second passages each having an open end opening into an associated one of the compression spaces at a predetermined circumferential location at which pressure within the associated one of the compression spaces changes from a negative value into a positive value when each of the vanes passes the predetermined circumferential location.

Preferably, the vane compressor includes a side block forming part of the cylinder, and wherein the first and second passages are formed in the side block.

More preferably, the predetermined circumfereintial location is a location which is slightly downstream of a rotational angle position of each of the vanes at which a compression stroke starts.

The vane compressor may include capacity control means for controlling the capacity of the compressor by varying a position of each of the vanes at which a compression stroke starts, and wherein the predetermined circumferential location is a location which is slightly downstream of a rotational angle position of each of the vanes at which the compression stroke starts while the capacity means controls the capacity of the compressor to a minimum value.

The above and other objects, features and advantages of the invention will be more apparent from the ensuing detailed description taken in conjunction with the accompanying drawings.

DETAILED DESCRIPTION

The invention will now be described in detail with reference to the drawings showing an embodiment thereof.

Figure 1:
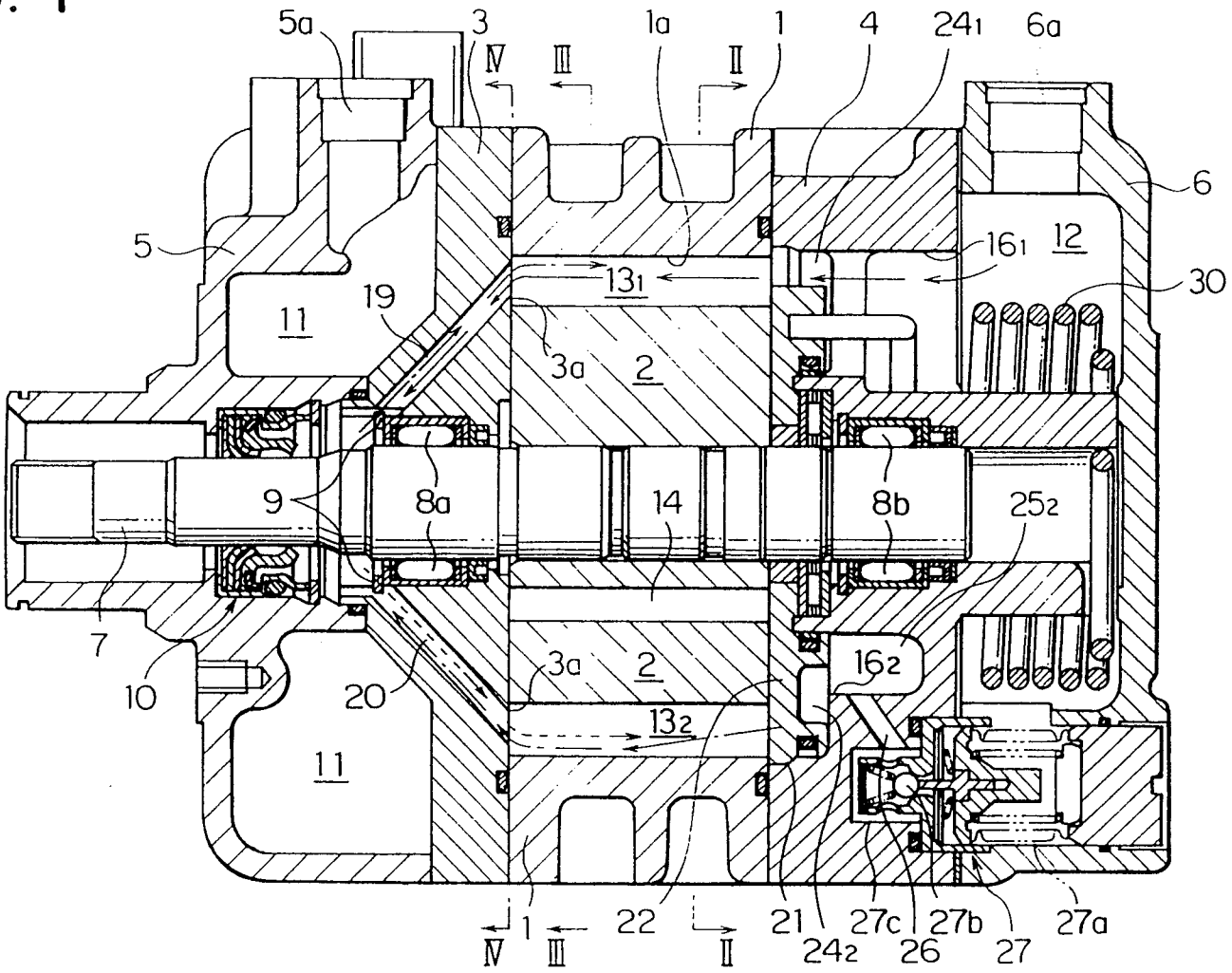
FIG. 1 is a longitudinal cross-sectional view of a variable capacity vane compressor provided with a lubricating oil supply device according to the invention.
Figure 2:
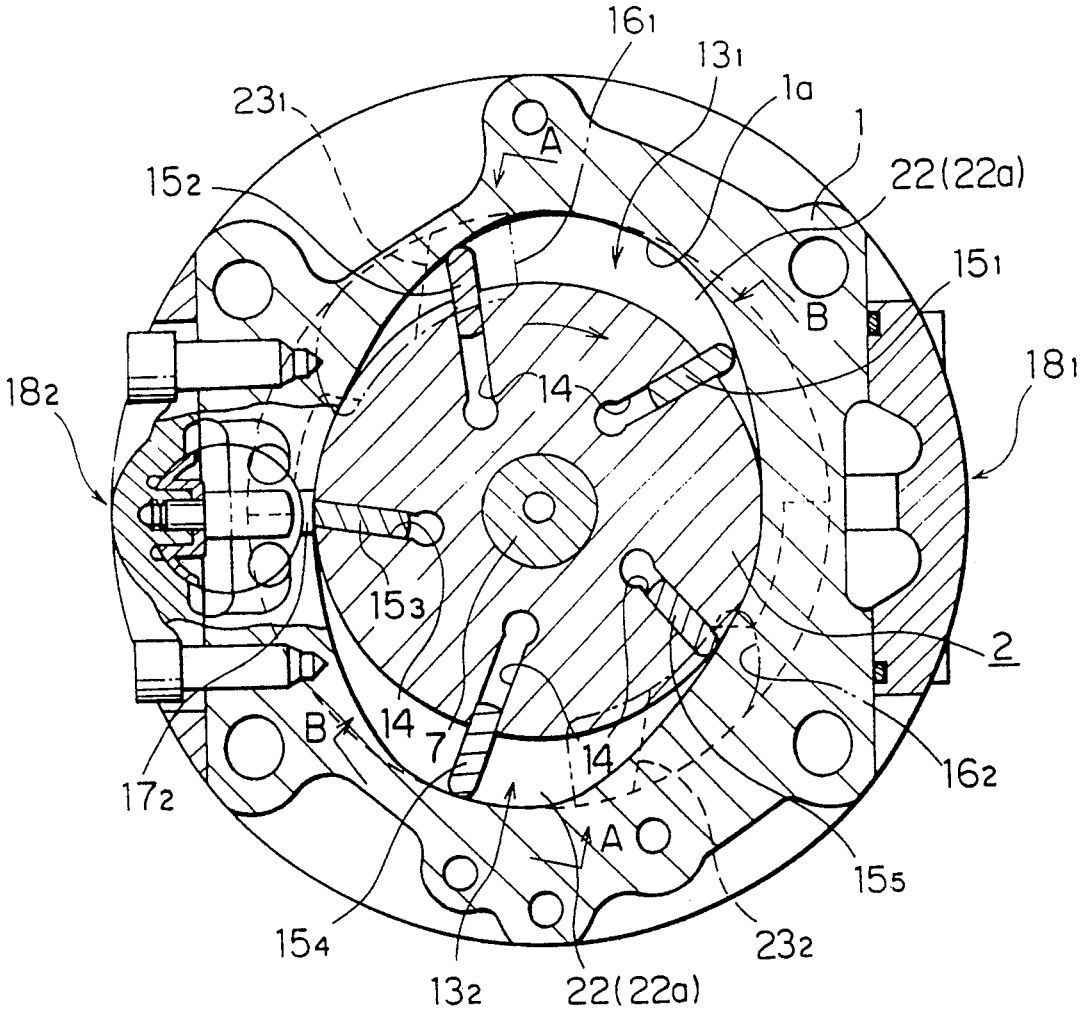
FIG. 2 is a transverse cross-sectional view taken along line II—II in FIG. 1.

Referring first to FIGS. 1 and 2, the basic construction of a vane compressor incorporating therein a lubricating oil supply device according to the invention will be explained.

FIG. 1 shows a variable capacity vane compressor which is capable of varying the capacity thereof. The vane compressor is composed mainly of a cylinder formed by a cam ring 1 having an inner peripheral surface 1*a* with a generally elliptical cross section, and a front side block 3 and a rear side block 4 closing open opposite ends of the cam ring 1, a cylindrical rotor 2 rotatably received within the cylinder, a front head 5 and a rear head 6 secured to outer ends of the respective front and rear side blocks 3 and 4, a driving shaft 7 extending through the front side block 3 for coupling with an output shaft of an engine via an electromagetic clutch, neither shown, and a control element 22 rotatably received in the rear side block 4 for varying the opening of refrigerant inlet ports.

The driving shaft 7 is rotatably supported by needle bearings 8*a* and 8*b* provided at an intermediate portion and one rear end portion thereof, respectively. The driving shaft 7 has a front end portion on the electromagnetic clutch side extending through a shaft seal chamber 9 defined between the front side block 3 and the front head 4, and sealed against the outside by a sealing member (shaft seal) 10 in an airtight manner.

A discharge port 5*a* is formed in an upper wall of the front head 5, through which a refrigerant gas with lubricating oil mixed therein is to be discharged as a thermal medium, while a suction port 6*a* is formed in an upper wall of the rear head 6, through which the refrigerant gas is to be drawn into the compressor. The discharge port 5*a* and the suction port 6*a* communicate, respectively, with a discharge pressure chamber 11 defined by the front head 5 and the front side block 3, and a suction chamber 12 defined by the rear head 6 and the rear side block 4.

Figure 3:
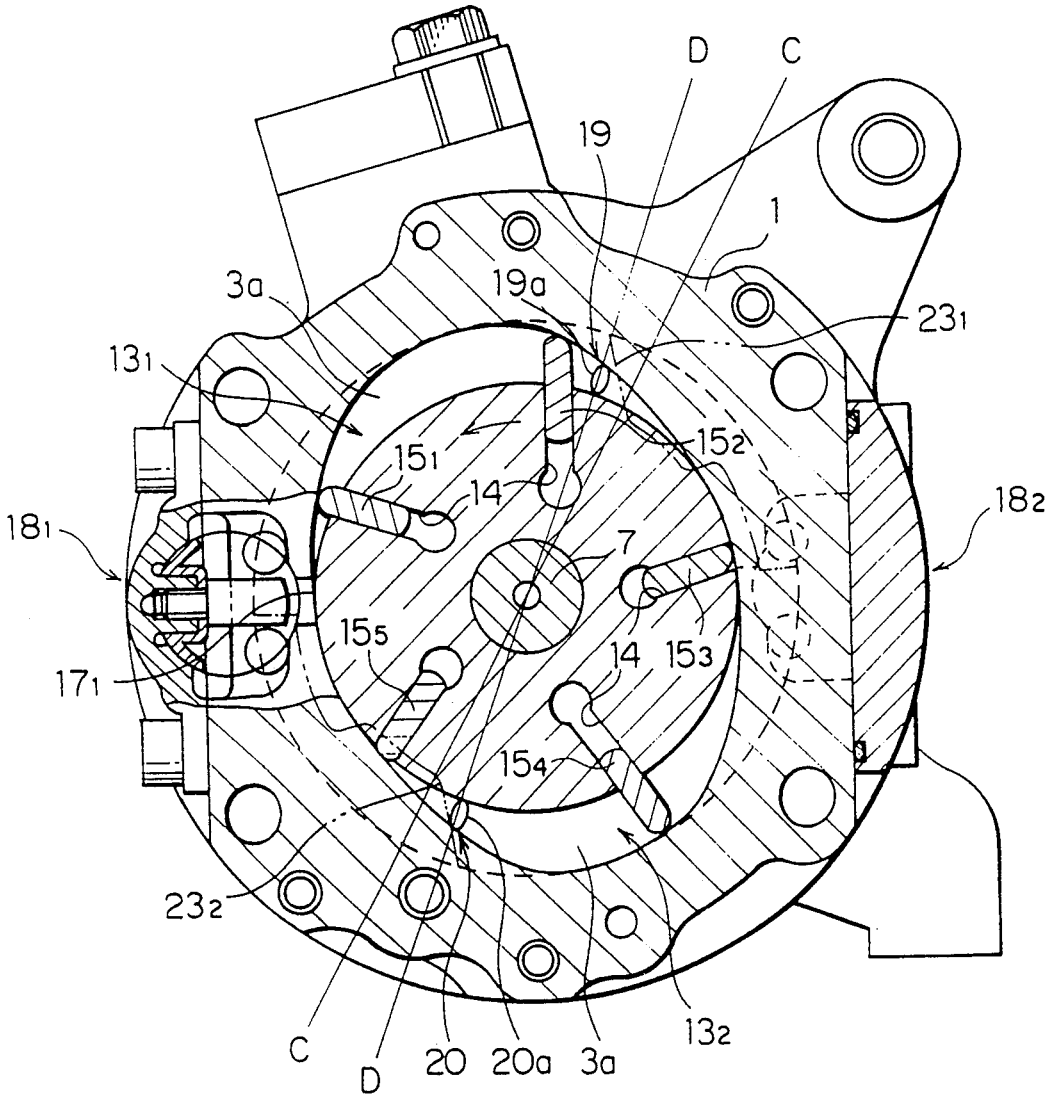
FIG. 3 is a transverse cross-sectional view taken along line III—III in FIG. 1.

As shown in FIGS. 1 through 3, a pair of compression spaces $13_1$, $13_2$ are defined at diametrically opposite locations between the inner pheripheral surface 1*a* of the cam ring 1, the outer peripheral surface of the rotor 2, an end face 3*a* of the front side block 3 on the cam ring 1 side, and an end face 22*a* of a control element 22 on the cam ring 1 side.

The rotor 2 has its outer peripheral surface formed therein with a plurality of, e.g. five, axial vane slits 14 at circumferentially equal intervals, in each of which a vane $15_1$–$15_5$ is radially slidably fitted. Each compression chamber is defined between successive two (e.g. the vanes $15_1$ and $15_2$ in FIG. 2) of the vanes $15_1$–$15_5$ to compress compression medium therein.

Refrigerant inlet ports $16_1$, $16_2$ are formed in the rear side block 4 at diametrically opposite locations, as shown by the two-dot-chain lines in FIG. 2. These refrigerant inlet ports $16_1$, $16_2$ are located at such locations that they become closed when a compression chamber defined between successive two ones (e.g. the vanes $15_1$ and $15_2$ in FIGS. 2 and 3) of the vanes $15_1$–$15_5$ assumes the maximum volume. These refrigerant inlet ports $16_1$, $16_2$ axially extend through the rear side block 4, as shown in FIG. 1, and through which the suction chamber 12 and the compression spaces $13_1$, $13_2$ are communicated with each other.

Refrigerant outlet ports $17_1$, $17_2$ are formed through opposite lateral side walls of the cam ring 1 at diametrically opposite locations, though only one of them is shown in FIGS. 2 and 3. The cam ring 1 has opposite lateral side walls thereof provided with respective discharge valves $18_1$, $18_2$, which open in response to discharge pressure to thereby open the refrigerant outlet ports $17_1$, $17_2$. Further formed in the cam ring 1 and front side block 3 is a communication passage, not shown, which feeds a compressed refrigerant gas from the compression chamber discharged from the refrigerant outlet port $17_1$, $17_2$ into the discharge pressure chamber 11, when the discharge valve $18_1$, $18_2$ opens to open the refrigerant outlet port $17_1$, $17_2$.

Figure 4:
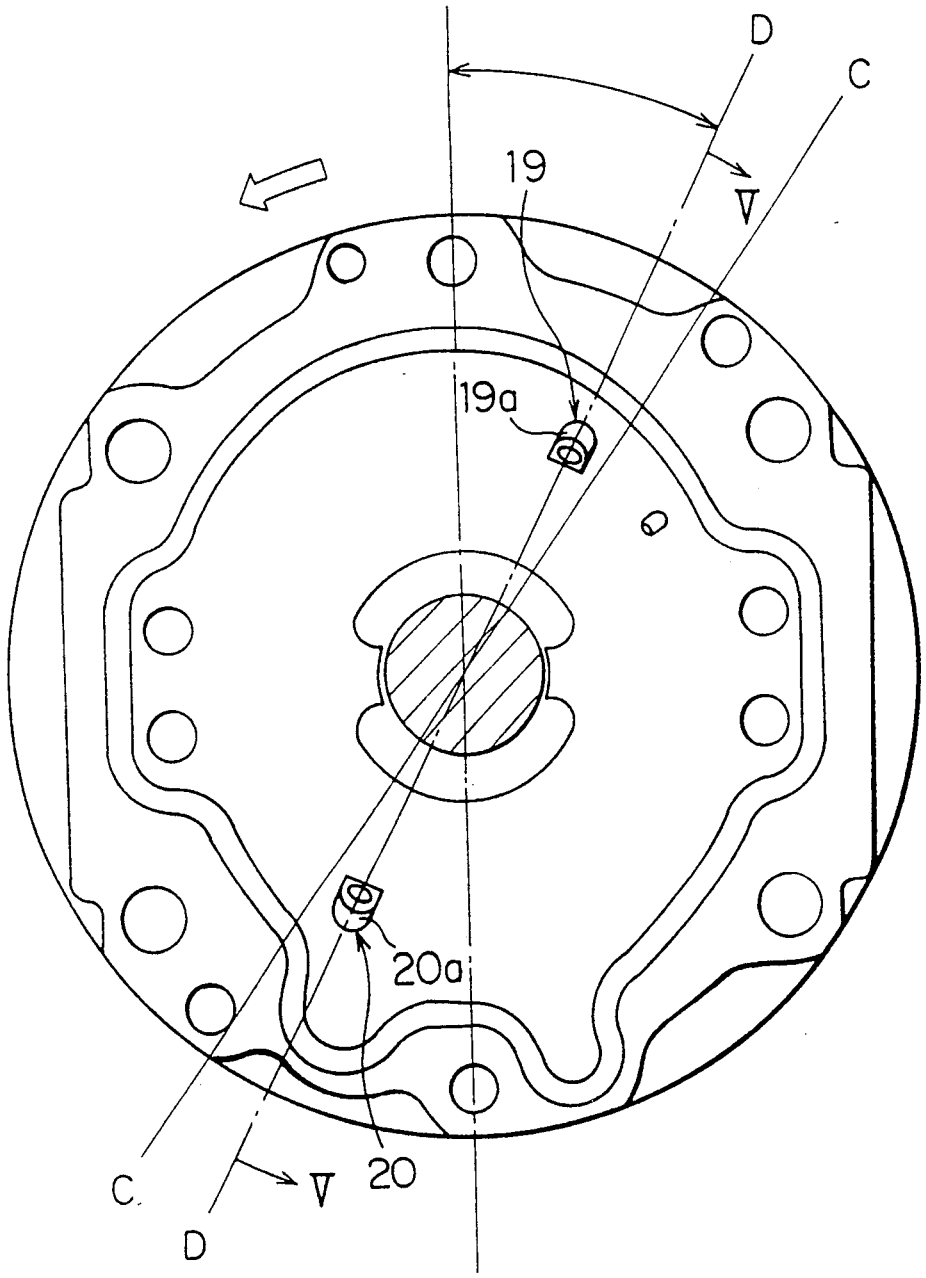
FIG. 4 is a transverse cross-sectional view taken along line IV—IV in FIG. 1.
Figure 5:
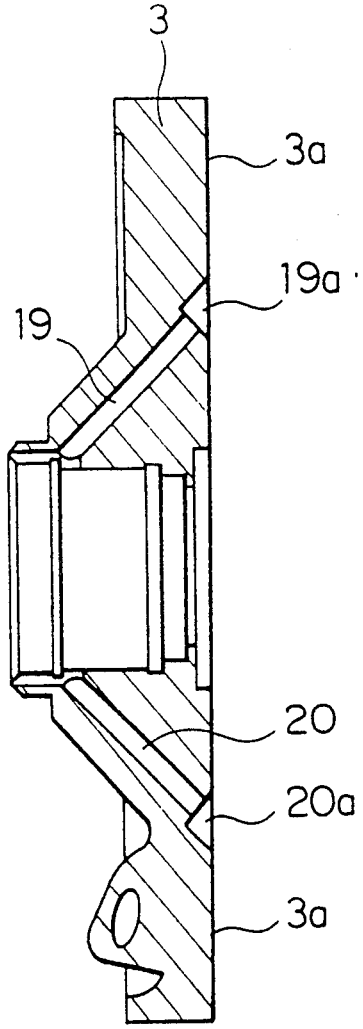
FIG. 5 is a sectional view taken along line V—V in FIG. 4.

Lubricating oil passages 19, 20, which constitute a lubricating oil supply device M, hereinafter described in detail, are each formed through the front side block 3 at a predetermined circumferential location (locations D in FIGS. 3 and 4) with respect to rotation of the rotor 2, to communicate each of the compression spaces $13_1$, $13_2$ with the seal chamber 9. With this arrangement, part of compression medium, which has once been supplied into the compression space $13_1$, $13_2$ through the refrigerant inlet port $16_1$, $16_2$, is introduced into the shaft seal chamber 9 through the associated lubricating oil passage 19, 20, and then returned therefrom to the associated compression space $13_1$, $13_2$ through the associated lubricating oil passage 19, 20.

The rear side block 4 has an end face opposed to the rotor 2, in which is formed an annular recess 21 which is continuous with the refrigerant inlet ports $16_1$, $16_2$. A control element 22, which is in the form of an annulus, is received in the annular recess 21 for rotation about its own axis in opposite circumferential directions. The control element 22 has its outer peripheral edge formed with a pair of diametrically opposite arcuate cut-outs $23_1$, $23_2$ (as shown in FIG. 2), and one side surface thereof remote from the rotor 2 formed integrally with a pair of diametrically opposite pressure-receiving protuberances $24_1$, $24_2$ axially projected therefrom and acting as pressure-receiving elements. A pair of pressure working chambers $25_1$, $25_2$ are formed in a bottom of the annular recess 21, though only one $25_2$ of them is shown in FIG. 1. The pressure-receiving protuberances $24_1$, $24_2$ are slidably received in respective pressure working chambers $25_1$, $25_2$. The interior of each of the pressure working chambers $25_1$, $25_2$ is divided into a first pressure chamber and a second pressure chamber, neither shown, by the associated pressure-receiving protuberance $24_1$, $24_2$. The first pressure chambers are supplied with pressure from the suction chamber 11 through the corresponding inlet port $16_1$, $16_2$, whereas the second pressure chambers are supplied with pressure from the discharge pressure chamber 11 through a communication passage, not shown.

The second pressure chambers are communicatable with the suction chamber 12 through a communication passage 26 formed in the rear side block 4 and a control valve device 27 arranged in the passage 26, as shown in FIG. 1. The control valve device 27 is mainly composed of a flexible bellows 27*a*, a ball valve body 27*b*, and a coiled spring 27*c*, and operable in response to low pressure prevailing within the suction chamber 12 to allow pressure within the second pressure chambers to leak therethrough into the suction chamber 12. Thus, the control valve device 27 operates to cause the control element 22 to rotate in response to change in the pressure within the suction pressure chamber 12. Specifically, when the suction pressure is above a predetermined set value, the control valve device 27 is in a valve closing position so that the pressure within the second pressure chambers is maintained at a high level, thereby causing the control element 22 to rotate in a counterclockwise direction as viewed in FIG. 2. On the other hand, when the suction pressure is below the predetermined set value, the control valve device 27 is in a valve opening position to allow the pressure within the second pressure chambers leak therethrough into the suction chamber 12. On this occasion, the control element 22 is rotated by the force of a coiled spring 30 in a clockwise direction as viewed in FIG. 2. In this manner, the pressure within the second pressure chambers is varied by the control valve device 27 depending upon whether the suction pressure is above the predetermined set value or not, so that the control element 22 is rotated in opposite directions between a full capacity position, in which downstream ends of the cut-outs $23_1$, $23_2$ are positioned in positions A for obtaining the maximum capacity, and a partial capacity position, in which downstream ends of the cut-outs $23_1$, $23_2$ are positioned in positions B for obtaining the minimum capacity, whereby the suction pressure is controlled to the predetermined set value.

Thus, the compression starting timing and hence the capacity of the compressor is varied by the rotation of the control element 22.

The lubricating oil supply device M of the variable capacity vane compressor constructed as above will now be explained.

The lubricating oil supply device M according to the invention is designed to supply refrigerant gas with lubricating oil mixed therein under low pressure into the shaft seal chamber 9 into which the bearing 8*a* on the front side opens to lubricate the bearing 8*a* and at the same time efficiently cool the shaft seal 10 within the shaft seal chamber 9.

Particularly, in the case where the discharge pressure chamber 11 is provided on the front side of the compressor as in the present embodiment, the shaft seal 10 is located on the discharge pressure chamber 11 side, and is apt to be heated to a high temperature by compressed refrigerant gas within the chamber 11. Efficient cooling of the shaft seal 10 is therefore essentially required to prevent degradation in the durability of the shaft seal 10.

In order to enhance the effect of cooling of the shaft seal 10 by means of lubricating oil, the lubricating oil supply device M according to the invention efficiently introduces compression medium with lubricating oil mixed therein into the shaft seal chamber 9 in a manner having its pressure maintained at a low value.

To achieve the efficient introduction of compression medium, the present invention is based on a finding that the pressure within the compression space $13_1$, $13_2$ changes from a negative value (when the compression chamber is on the suction stroke) into a positive value (when the compression chamber is on the compression stroke) with rotation of the rotor 2. According to the invention, the above pressure change is utilized to cause compression medium to smoothly flow between the compression space $13_1$, $13_2$ and the shaft seal chamber 9 (pulsation effect).

Specifically, the lubricating oil passages 19, 20 communicating between the shaft seal chamber 9 and the respective compression spaces $13_1$, $13_2$ are provided at diametrically opposite locations in the front side block 3 such that one end of each of the passages 19, 20 opens in the end face 3*a* of the front side block 3 facing the rotor 2 at a predetermined angular location with respect to rotation of each vane 15. In other words, the lubricating oil passages 19, 20 each have an open end 19*a*, 20*a* located at a predetermined circumferential location at which the pressure within the compression space $13_1$, $13_2$ changes from a negative value (when the compression chamber is on the suction stroke) into a positive value (when the compression chamber is on the compression stroke) with rotation of the rotor 2. In the illustrated embodiment, the open ends 19*a*, 20*a* of the lubricating oil passages 19, 20 are each located at a circumferential location (location D in FIG. 3, at which there occurs no temperature rise in compression medium due to compression of same) which is downstream by 10 degrees with reference to a vane rotational angle position (position C in FIG. 3) at which the compression stroke starts during the full capacity operation of the compressor.

With the above arrangement of the open ends 19*a*, 20*a*, immediately after a leading one of two adjacent vanes (e.g. vane $15_2$ in FIG. 3) passes an open end (e.g. open end 19*a*), the compression chamber defined between the leading vane ($15_2$) and the trailing vane ($15_3$) starts the suction stroke, whereby negative pressure is created therein, whereas immediately before a trailing one of two adjacent vanes (e.g. vane $15_5$ in FIG. 3) passes an open end (e.g. the open end 20*a*), the compression chamber defined between the leading vane ($15_4$) and the trailing vane ($15_5$) starts the compression stroke, whereby positive pressure is created therein.

Accordingly, as the rotor 2 rotates, the pressure within the compression chamber into which the associated open end 19*a*, 20*a* opens is varied in a pulsating manner i.e. from a negative value into a positive value, and vice versa.

The pulsation in pressure within the compression chamber into which the associated open end opens (hereinafter merely referred to as "the compression chamber") serves to supply compression medium containing lubricating oil to the shaft seal chamber 9 in the following manner:

When the pressure within the compression chamber has a positive value, part of the compression medium within the compressin chamber is introduced into the shaft seal chamber 9 through the associated lubricating oil passage 19, 20, thereby increasing the amount of compression medium within the chamber 9. When the pressure within the compression chamber then changes into a negative value, most of the compression medium, which has been introduced into the shaft seal chamber 9, is sucked back into the compression chamber through the associated lubricating oil passage 19, 20. This action is repeated by the rotation of the vanes to thereby supply a sufficient amount of compression medium into the shaft seal chamber 9 (pulsation effect).

The lubricating oil supply device of the invention, utilizing the pulsation effect, can be simply realized by additionally forming only the lubricating oil passages communicating the associated compression chambers with the shaft seal chamber at predetermined vane rotational angle positions in a conventional compressor, but can effect lubrication and cooling to a much higher degree than the conventional lubricating oil supply devices.

Particularly, the lubricating oil supply device of the invention, if applied to a vane compressor having a pair of compression spaces, and an odd number of, e.g. five, vanes, as in the present embodiment, can provide especially excellent results as follows:

If an odd number of vanes are arranged at circumferentially equal intervals in the rotor of a vane compressor having a pair of compression spaces, when the pressure within a compression chamber in one compression space into which an open end of one of the lubricating oil passages 19, 20 opens assumes a positive value, the pressure within a compression chamber in the other compression space into which an open end of the other lubricating oil passage opens assumes a negative value, thereby giving a phase difference in pressure of 180 degrees between the two compression chambers.

Consequently, when the pressure within one compression chamber associated with one open end 19*a* in one compression space $13_1$ in FIG. 1 assumes a positive value, and accordingly part of the compression medium within the suction chamber 12 is introduced through the compression space $13_1$ and the lubricating oil passage 19 into the shaft seal chamber 9, the pressure within the other compression chamber associated with the other open end 20*a* in the other compression space $13_2$ in FIG. 1 assumes a negative value so that most of the compression medium, which has been supplied into the shaft seal chamber 9 through the lubricating oil passage 19, is supplied into the other compression space $13_2$ through the other lubricating oil passage 20, as shown by the broken-line arrows in FIG. 1.

Conversely, when the pressure within the one compression chamber associated with the one open end 19*a* in the one compression space $13_1$ changes into a negative value, there takes place a flow of compression medium in the direction reverse to the above, as shown by the one-dot-chain line arrows in FIG. 1. As a result, compression medium is circulated through the shaft seal chamber 9 in a sufficient amount, thereby enhancing the efficiency of lubrication and cooling by compression medium.

In a variable capacity type vane compressor, in which the compression starting timing is varied by varying the circumferential position of an edge of a cut-out in a control element, as in the present embodiment, the open end of the lubricating oil passage is arranged downstream by not more than approximately 10 degrees with reference to the compression stroke starting angle of the vane assumed during the full capacity operation of the compressor. The reason for thus determining the location of the open end 19*a*, 20*a* with reference to the compression stroke start timing during the full capacity operation of the compressor is that the shaft seal portion is apt to be heated to the greater extent by the compressed compression medium within the discharge pressure chamber when the compressor is in the full capacity operation, thereby requiring the higher efficiency of cooling the shaft seal during the full capacity operation of the compressor.

According to an application of the lubricating oil supply device constructed as above to a vane compressor having a pair of compression spaces and an odd number of, e.g., five, vanes, it was ascertained that the shaft seal was lowered in temperature by approximately 3° C. during idling operation (e.g. 800 rpm) and by approximately 10° C. during high-speed operation (e.g. 3000 rpm) as compared with a compressor having a conventional lubricating oil supply device as disclosed by Japanese Provisional Patent Publication (Kokai) No. 62-70684.

What is claimed is:

1. In a vane compressor having a cylinder, a driving shaft having a portion thereof arranged within said cylinder, a rotor received within said cylinder and secured on said driving shaft, at least one compression space defined between said rotor and said cylinder, a plurality of vanes carried by said rotor, a shaft seal and a bearing fitted on said driving shaft and disposed adjacent to each other, and lubricating oil supply means for supplying compression medium to said shaft seal and said bearing, the improvement wherein said lubricating oil supply means comprises at least one passage extending between said at least one compression space and said shaft seal and said bearing, said at least one passage having an open end opening into said at least one compression space at a predetermined circumferential location at which pressure within said at least one compression space changes from a negative value into a positive value when each of said vanes passes said predetermined circumferential location.

2. A vane compressor as claimed in claim 1, including a side block forming part of said cylinder, and wherein said at least one passage is formed in said side block.

3. A vane compressor as claimed in claim 1, wherein said predetermined circumfereintial location is a location which is slightly downstream of a rotational angle position of each of said vanes at which a compression stroke starts.

4. A vane compressor as claimed in claim 1, including capacity control means for controlling the capacity of said compressor by varying a position of each of said vanes at which a compression stroke starts, and wherein said predetermined circumferential location is a location which is slightly downstream of a rotational angle position of each of said vanes at which said compression stroke starts while said capacity means is controlling the capacity of said compressor to a minimum value.

5. In a vane compressor having a cylinder, a driving shaft having a portion thereof arranged within said cylinder, a rotor received within said cylinder and secured on said driving shaft, a pair of compression spaces defined between said rotor and said cylinder at circumferentially opposite locations, an odd number of vanes carried by said rotor and circumferentially arranged at equal intervals, a shaft seal and a bearing fitted on said driving shaft and disposed adjacent to each other, and lubricating oil supply means for supplying compression medium to said shaft seal and said bearing, the improvement wherein said lubricating oil supply means comprises first and second passages, said first passage extending between one of said compression spaces and said shaft seal and said bearing, said second passage extending between the other of said compression spaces and said shaft seal and said bearing, said first and second passages each having an open end opening into an associated one of said compression spaces at a predetermined circumferential location at which pressure within said associated one of said compression spaces changes from a negative value into a positive value when each of said vanes passes said predetermined circumferential location.

6. A vane compressor as claimed in claim 5, including a side block forming part of said cylinder, and wherein said first and second passages are formed in said side block.

7. A vane compressor as claimed in claim 5, wherein said predetermined circumfereintial location is a location which is slightly downstream of a rotational angle position of each of said vanes at which a compression stroke starts.

8. A vane compressor as claimed in claim 5, including capacity control means for controlling the capacity of said compressor by varying a position of each of said vanes at which a compression stroke starts, and wherein said predetermined circumferential location is a location which is slightly downstream of a rotational angle position of each of said vanes at which said compression stroke starts while said capacity means is controlling the capacity of said compressor to a minimum value.

* * * * *